US011078801B2

(12) United States Patent
Guegan et al.

(10) Patent No.: US 11,078,801 B2
(45) Date of Patent: Aug. 3, 2021

(54) AIR-GAP FINS FOR A TURBINE ENGINE COMPRESSOR

(71) Applicant: Safran Aircraft Engines, Paris (FR)

(72) Inventors: Damien Bernard Emeric Guegan, Moissy-Cramayel (FR); Sébastien Claude Cochon, Moissy-Cramayel (FR); Pierre-Hugues Ambroise Maxime Victor Retiveau, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 61 days.

(21) Appl. No.: 16/519,875

(22) Filed: Jul. 23, 2019

(65) Prior Publication Data

US 2020/0032662 A1 Jan. 30, 2020

(30) Foreign Application Priority Data

Jul. 24, 2018 (FR) ..... 1856864

(51) Int. Cl.

| | |
|---|---|
| ***F01D 5/14*** | (2006.01) |
| ***F01D 9/04*** | (2006.01) |
| ***F01D 11/00*** | (2006.01) |
| ***F04D 29/16*** | (2006.01) |

(Continued)

(52) U.S. Cl.

CPC ..... *F01D 9/041* (2013.01); *F01D 25/24* (2013.01); *F05D 2240/50* (2013.01); *F05D 2250/90* (2013.01)

(58) Field of Classification Search

CPC ..... F01D 5/143; F01D 9/041; F01D 11/001; F01D 25/24; F04D 29/164; F04D 29/542; F05D 2240/50; F05D 2240/80; F05D 2250/90

See application file for complete search history.

(56) References Cited

U.S. PATENT DOCUMENTS 5,211,533 A * 5/1993 Walker ..... F01D 11/001 415/115
8,043,046 B2 * 10/2011 Guemmer ..... F04D 29/542 415/115

(Continued)

FOREIGN PATENT DOCUMENTS

EP 2 138 727 A2 12/2009
EP 2 316 632 A1 5/2011
WO WO 2011/148101 A1 12/2011

*Primary Examiner* — Igor Kershteyn
(74) *Attorney, Agent, or Firm* — Blank Rome LLP

(57) ABSTRACT

A vane stage with a longitudinal axis designed to be fitted in a turbine engine compressor. The van stage has an annular row of mobile vanes arranged upstream from an annular row of stator vanes. The annular row of stator vanes has a radially internal annular platform bearing radial blades, an upstream annular portion of which is arranged upstream from the blades and is surrounded radially outwards by a downstream annular portion of an annular platform of the upstream row of mobile vanes. The upstream annular portion of the annular platform of the annular row of stator vanes has a radially external annular face from which fins extend, which are distributed around the longitudinal axis and extend radially outwards towards the downstream annular portion of the platform of the annular row of mobile vanes.

12 Claims, 3 Drawing Sheets

(51) Int. Cl.
*F04D 29/54* (2006.01)
*F01D 25/24* (2006.01)

(56) References Cited

U.S. PATENT DOCUMENTS

| | | | | |
|---|---|---|---|---|
| 8,202,039 | B2 * | 6/2012 | Guemmer | F04D 29/684<br>415/55.5 |
| 8,303,258 | B2 * | 11/2012 | Aubin | F04D 29/681<br>416/193 A |
| 2010/0098527 | A1 * | 4/2010 | Guemmer | F04D 27/0207<br>415/115 |
| 2010/0143140 | A1 * | 6/2010 | Guemmer | F04D 29/542<br>416/193 A |
| 2013/0064673 | A1 * | 3/2013 | Domereq | F04D 29/544<br>416/223 R |
| 2013/0318982 | A1 | 12/2013 | Kim | |
| 2014/0010638 | A1 * | 1/2014 | Perrot | F04D 29/681<br>415/165 |

* cited by examiner

AIR-GAP FINS FOR A TURBINE ENGINE COMPRESSOR

CROSS-REFERENCE TO RELATED APPLICATIONS

This application claims priority to French Patent Application No. 1856864, filed Jul. 24, 2018, the entirety of which is incorporated by reference herein.

TECHNICAL FIELD

The present invention relates to a vane stage designed to be fitted in a compressor of a turbine engine, particularly of the dual-flow type.

BACKGROUND

Conventionally, a compressor 10 comprises an axial alternation of annular rows of mobile vanes 12 and annular rows of stator vanes 14. A compression stage 16 is thus defined as comprising an annular row of mobile vanes 12 upstream followed by an annular row of stator vanes 14 downstream. Each annular row of stator vanes 14 comprises radial blades 18 extending between a radially internal annular platform 20 and a radially external annular platform 22, and each annular row of mobile vanes 12 comprises a plurality of blades 24 extending radially outwards from a radially internal annular platform 26. It is understood that each annular platform can be formed of a succession of elementary platforms circumferentially juxtaposed end to end. As can be clearly seen in FIG. 1, an annular casing 28 externally surrounds the annular rows of stator vanes 14 and rotor vanes 12 and serves to support the radially external platforms 22 of the annular rows of stator vanes 14. Likewise illustrated is the link connecting the annular row of mobile vanes 12 upstream to a mobile annular row 12 downstream arranged downstream from the annular row of stator vanes 14. This link 30 bears annular lips 32 sealedly interacting with a ring 34 made of abradable material borne by a radially internal face 36 of the radially internal platform 20 of the annular row of stator vanes 14.

As is clearly apparent from FIG. 1, when the compressed air flow 38 circulates from upstream AM to downstream AV, a portion of the air of the annular air stream 40 of primary air is able to circulate between the downstream end 20*b* (FIG. 2) of the annular platform 20 of the annular row of stator vanes and the downstream end 26*b* of the annular platform 26 of the downstream annular row of mobile vanes 12. This air can circulate between the annular lips and the abradable ring 34 and be reintroduced into the annular air stream 40 between the downstream end 26*b* of the platform 26 of the upstream annular row of mobile vanes 12 and the upstream end 20*a* of the annular row of stator vanes 14.

This air reinjection is performed at a certain flow rate with a certain speed and a certain direction. This flow 42, which is a parasitic air flow, the direction of which is not controlled, is found to be capable of having a significant impact on the performances and operability of the compressor 10 in stabilised mode.

Likewise, it is important to properly control the flow in the compressor 10 during the transient phases (acceleration followed by deceleration and subsequently reacceleration for example) in order to be able to improve the acceleration/deceleration of the turbojet and hence its responsiveness. It appears however that the parasitic secondary flow 42 radially inside the annular row of stator vanes 14 has an impact on transient phase operability. Indeed, the air in rotation has a degree of inertia that is not the same as that in the air stream 40, such that the reinjected parasitic air is then not adapted in terms of orientation relative to the stator vanes. This may result in air separations at the internal annular platform 20 of the stator vanes 14, reducing the performances and operability of the compressor 10. Indeed, the reinjected air, which is in rotation around the longitudinal axis X (FIG. 2), has a high inertia and an almost completely tangential direction that may cause a separation of the air flowing over the vanes of the stator 14 at the root of the blade 18, thereby reducing the pumping margin of the compressor 10.

In practice, when the air 42 is reinjected upstream from the annular row of stator vanes 14, deterioration in the performances of the compressor 10 manifests itself in two main ways:

- In the radial section, in the air reinjection area 44, air circulation in the air stream 40 can be obstructed at the root 46 of the blade 18. The result is that the air flow rate distribution over the radial dimension of the blade 18 is not that expected. The annular area of air, the flow rate of which is reduced i.e. the annular area at the root 46 of the blade 18, results in weakening of the stator vanes 14 on the one hand by injection of an air flow rate 42 that does not have the correct incidence and leads to separations, and of the vanes of annular row of mobile vanes 12 upstream on the other hand by a local increase in static pressure that may cause the rotor to operate closer to its pumping limit.
- The velocity vector of the reinjected air flow 42 upstream from the annular row of stator vanes 14 influences the orientation of the main air flow 38 of the annular air stream 40 such that orientation of the stator blades 18 is not optimum, thereby leading to a reduction in the pumping margin.

Although it is obviously desirable to limit as far as possible air recirculation 42, experience shows that parasitic recirculation 42 remains. The latter should therefore be taken into account in the design of the compressor 10 so that nominal functioning of the compressor 10 is affected as little as possible as a result.

SUMMARY

The present invention relates first of all to a vane stage, extending around a longitudinal axis, designed to be fitted in a turbine engine compressor, wherein the stage comprises an annular row of mobile vanes arranged upstream from an annular row of stator vanes, wherein the annular row of stator vanes comprises a radially internal annular platform bearing radial blades, an upstream annular portion of which (platform) is arranged upstream from said blades and is surrounded radially outwards by a downstream annular portion of an annular platform of the upstream row of mobile vanes, wherein the upstream annular portion of the annular platform of the annular row of stator vanes comprises a radially external annular face from which fins extend, which are distributed around the longitudinal axis and extend radially outwards towards the downstream annular portion of the platform of the annular row of mobile vanes.

The invention thus proposes to add fins in an annular gap delimited between two annular portions of platforms of an upstream annular row of mobile vanes and a downstream annular row of stator vanes in order to allow optimum guidance of the air reinjected into the annular air stream. Likewise, the fins allow optimum guidance of inflowing air at the stator vane grid.

Use of fins having a profile with a leading edge and a trailing edge connected together by an intrados face and an extrados face makes it possible to control the circumferential orientation of the air flow rate reinjected upstream from the stator vane grid so that it is correctly oriented to avoid disturbing the air flow in the annular air stream and thus optimally impinges on the leading edges of the blade of the annular row of stator vanes.

The stage configuration thus proposed improves the pumping margin of the compressor, particularly during successive transient phases (acceleration then deceleration followed by acceleration). Indeed, at the beginning of deceleration, the air in the cavity always has a high inertia (and therefore a major tangential component) whereas the air flow rate in air stream is lower. In this situation, the incidence at the root of the outlet guide vane is high, increasing its sensitivity to the phenomenon of separation. The fins thus serve to limit separations at the root of the outlet guide and therefore improve the pumping margin of the compressor.

According to another characteristic, the fins each comprise an intrados face and an extrados face oriented circumferentially in an identical manner to the intrados faces and extrados faces of the blades of the stator vanes. According to the invention, the fins are thus parameterised, i.e. configured in three dimensions like vanes, namely with a string law, a skeleton law and a thickness law.

With an annular row of fins, the function of outlet guide of the air flowing from the upstream cavity is to reduce the aerodynamic losses in this area, render guidance more effective and also have a greater positive effect on the flow in the air stream and the annular row of stator vanes of the air stream, which corresponds to the ultimate aim of improving the air flow and hence improving output.

Furthermore, the angle $\beta 1$ between the longitudinal axis and the tangent to the mean camber line at the leading edge of the fins is between 45° and 90°, preferably on the order of 80° to 90°, preferably on the order of 85°.

The mean camber line is the succession of points located half way between the extrados and intrados as measured perpendicularly to this same line. Since the recirculation air in rotation has a major tangential component, choice of the angle as indicated facilitates circulation of inflowing air of the fins.

According to another characteristic, the angle $\beta 2$ between the longitudinal axis and the tangent to the mean camber line at the trailing edge of the fins is on the order of the leading angle between the longitudinal axis and the tangent to the mean camber line at the leading edge of a blade in the row of stator vanes.

This preferential orientation relative to the trailing edge of the fins facilitates reintroduction of the recirculation air with a correct orientation at the inlet of the stator vane stage, so as to limit air separations at the roots of the blades of the stator vanes.

In a compressor, this angle $\beta 2$ is between 10° and 75° and may be on the order of 55°.

The relative pitch defined by S/C, where S is the distance between two leading edges of two circumferentially adjacent fins and C is the string of a fin, should preferably be determined so as not to cause sonic cutoff.

This is to be chosen between 0.3 and 0.9 so that the air flow in the fin grid does not cause any sonic blocking and associated aerodynamic losses.

In a practical embodiment of the invention, the external annular face of the upstream annular portion is tapered with a section increasing in the downstream direction.

This external annular face may be inclined by an alpha angle relative to the longitudinal axis of between 0° and 90°, preferably between 10° and 45° and more preferably on the order of 30°.

According to another characteristic, the external annular face of the upstream annular portion is tapered with a section increasing in the downstream direction.

The inclination of the annular face bearing the fins makes it possible to control the angular orientation relative to the longitudinal axis (i.e. the axis of the turbine engine) and in a radial plane of the reinjected flow rate. This inclined annular face also limits reintroductions of air at this point in the stabilised and transient operating phases.

The invention also relates to a turbine engine compressor comprising at least one stage according to any of the preceding claims, wherein a downstream annular row of mobile vanes is arranged axially downstream from the annular row of stator vanes and is connected to the annular row of mobile vanes upstream by means of an annular shroud extending radially inside the annular row of stator vanes and bearing lips sealedly interacting with a ring of abradable material borne by a radially internal annular platform of the annular row of stator vanes.

Likewise, the invention also relates to a turbine engine comprising a compressor as described herein.

The invention will be better understood and other details, characteristics, and advantages of the invention will appear on reading the following description given by way of non-limiting example and with reference to the accompanying drawings.

DETAILED DESCRIPTION

In the present document, the terms internal and external in addition to interior and exterior are to be interpreted in relation to the longitudinal axis X. Also, the terms upstream and downstream are to be interpreted in relation to the direction of flow of the air flow. Likewise, the term annular denotes components extending angularly around the longitudinal axis X without these components necessarily being formed of a single piece. Hence, an annular platform, i.e. one that extends in a ring shape, may comprises a plurality of elementary platforms arranged end to end without the ends of said platforms necessarily being mutually contiguous. The overall shape of the platform is nevertheless annular.

Figure 2:
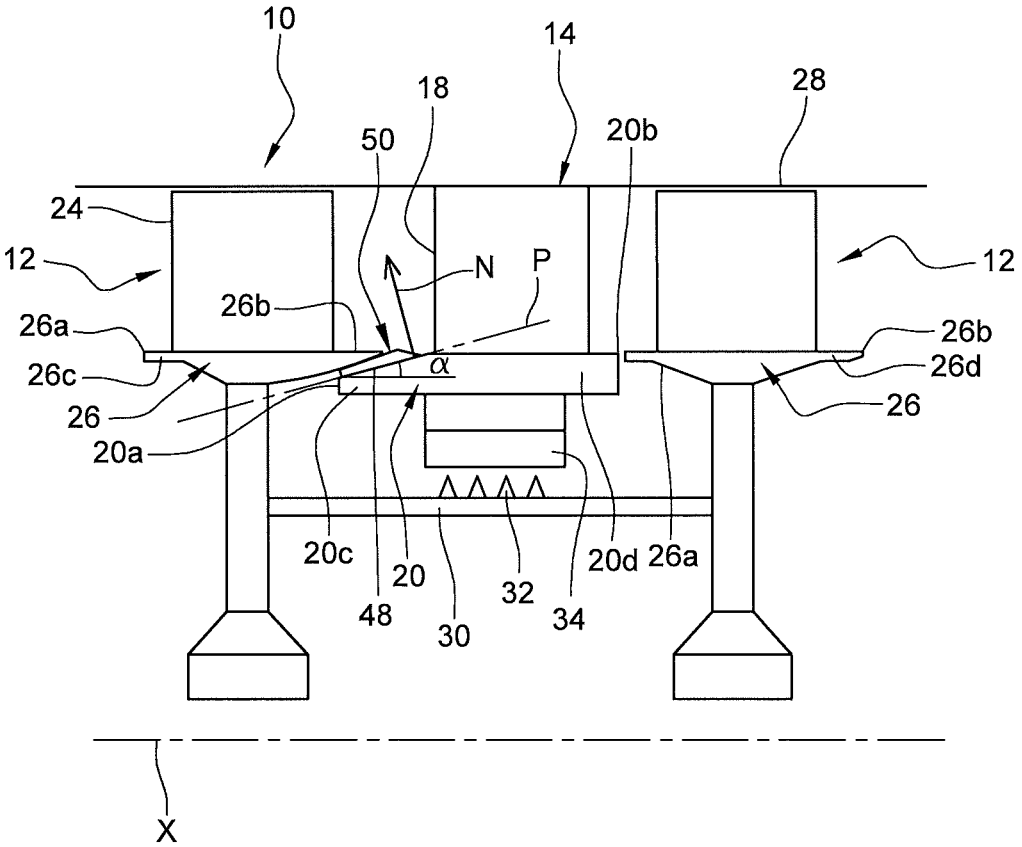
FIG. 2 is a schematic illustration of a portion of a compressor according to the invention.

FIG. 2 illustrates a stage 16 of a compressor 10 with a longitudinal axis X comprising an annular row of rotor vanes 12 upstream and an annular row of stator vanes 14 downstream. The annular row of stator vanes 14 is mounted upstream from the annular row of rotor vanes 12 of the downstream stage 16. As clearly shown, the blades 24 of the mobile vanes 12 and the blades 18 of the stator vanes 14 extend radially outwards from a radially internal annular platform 20, 26. The internal annular platform 20 of the annular row of stator vanes 14 comprises an upstream annular portion 20*c* arranged upstream from the stator blades 18 and a downstream annular portion 20*d* arranged downstream from said stator blades 18. Likewise, the annular platform 26 of the upstream annular row of rotor vanes 12 in addition to the annular platform 26 of the downstream annular row of rotor vanes 12 each comprise upstream 26*c* and downstream 26*d* annular portions arranged upstream and downstream, respectively from the blades 24. As can be seen in FIG. 2, it is noticed that the upstream annular portion 20*c* of the annular platform 20 of the annular row of stator vanes is arranged radially inside the downstream annular portion 26*b* of the annular platform 26 of the upstream annular row of mobile vanes.

Figure 1:
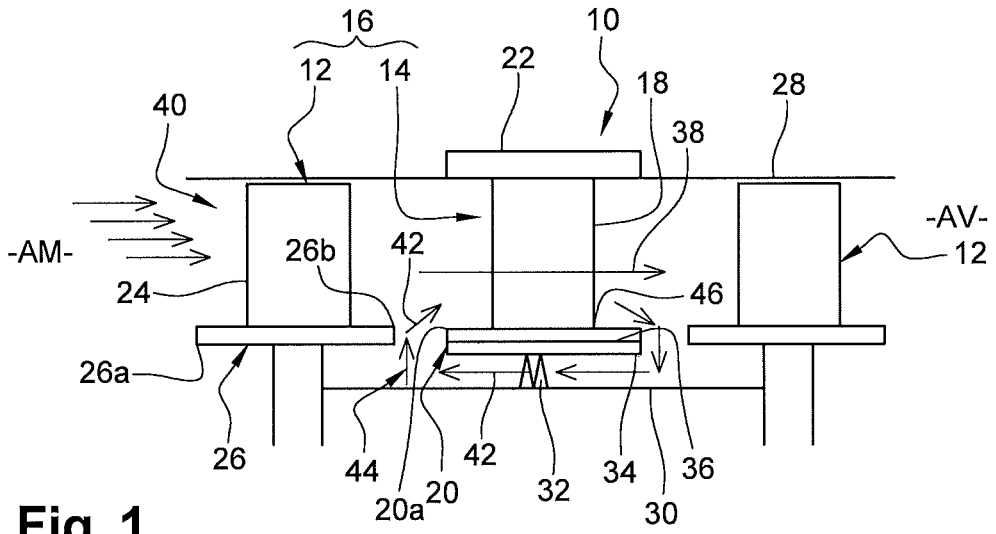
FIG. 1, already described above, is a schematic illustration of a portion of a compressor of a turbine engine.

Likewise, it is noticed that the annular rows of rotor vanes 12 are connected to each other by an annular shroud 30 bearing annular lips 32 sealedly interacting by friction with a ring 34 made of abradable material, so as to limit downstream to upstream air circulations as mentioned previously in connection with FIG. 1 of the prior art.

Figure 3:
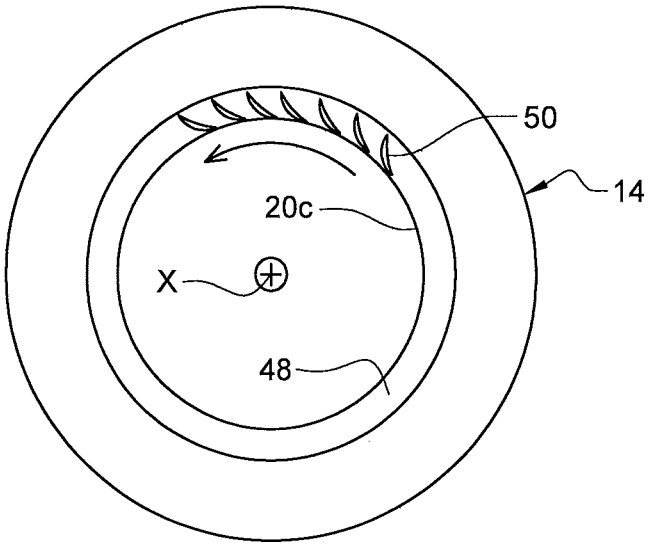
FIG. 3 is a schematic view along the longitudinal axis of the annular row of stator vanes in FIG. 2.

As illustrated in FIG. 2 as well as in FIG. 3, the upstream annular portion 20*c* of the annular stator platform 20 features a radially external annular face 48 that is obliquely inclined relative to the longitudinal axis X. More specifically, this radially external annular face 48 is tapered, i.e. has the shape of a truncated cone of revolution, having a section increasing in the downstream direction. The alpha angle of the external annular face relative to the longitudinal axis is between 5° and 90°, preferably between 10° and 45° and more preferably on the order of 30°.

Likewise, fins 50 are formed on the upstream annular portion 20*c* of the stator platform 20, with these fins 50 being regularly distributed around the longitudinal axis X and extending radially outwards in the direction of the downstream annular portion 26*d* of the upstream mobile platform 26.

During operation, the parasitic air 42 circulating in the annular gap between the downstream end 20*b* of the stator platform 20 and of the annular platform 26 of the downstream annular row of mobile vanes 12 and circulating through the sealing device with lips 32, thus flows with an angle α greater than zero which makes it possible to control the angular orientation relative to the longitudinal axis (i.e. the axis of the turbine engine) and in a radial plane of the reinjected flow rate and limits introductions of air into the annular gap between the downstream end 26*b* of the annular platform 26 of the upstream annular row of mobile vanes 12 and the upstream end 20*a* of the annular row of stator vanes 14.

Figure 4:
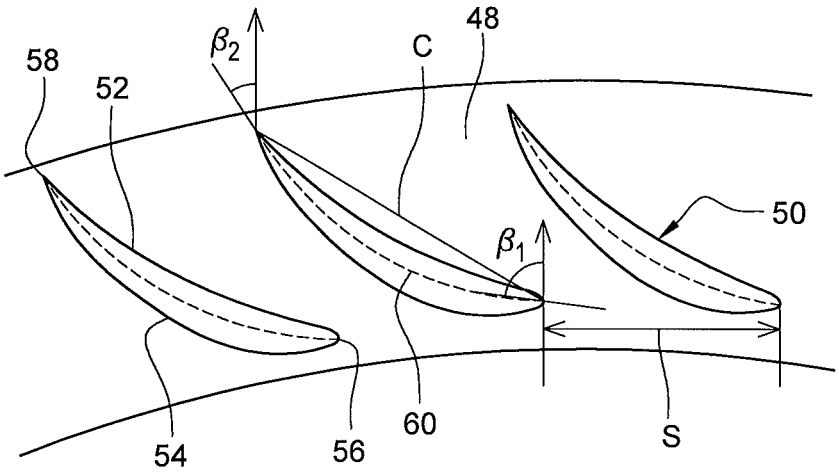
FIG. 4 is a schematic top view of fins according to the invention.
Figure 5:
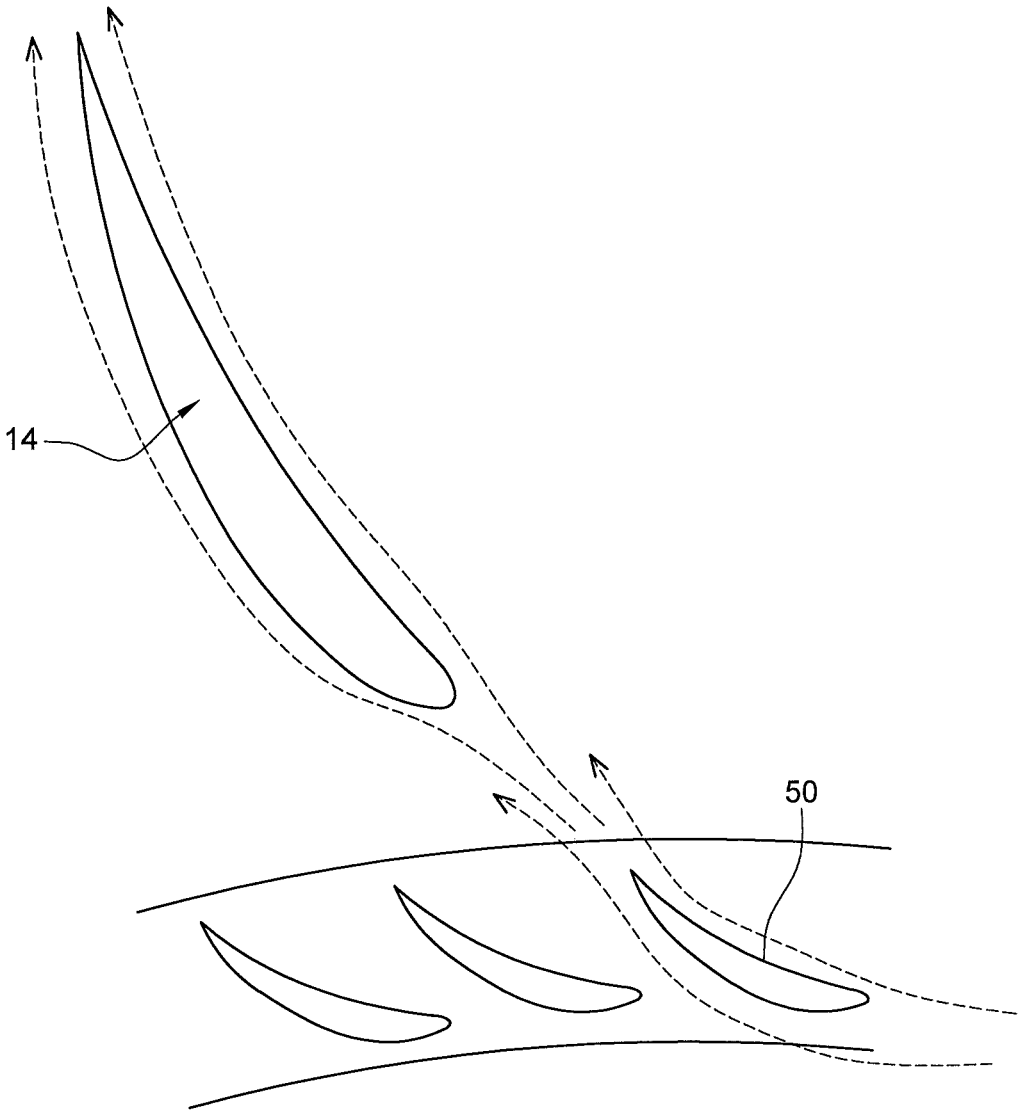
FIG. 5 is a schematic view of the air flow through fins in the configuration according to the invention.

Likewise, as illustrated in FIG. 4, each fin 50 has an intrados face 52 and an extrados face 54 connected to each other by a leading edge 56 and a trailing edge 58. These vanes therefore do not have a symmetrical profile according to their string, which is represented by the letter C in FIG. 4. The orientation of the fins can be defined by the angle β1 in relation to the leading edge and the angle β2 in relation to the trailing edge. These angles β1 and β2 are determined in a plane P perpendicular to a normal N on the external annular face 48 of the upstream annular portion 20*c* of the annular platform 20, with this plane P passing through the leading edge 56 of the fin (FIG. 2).

According to the given definition of said plane P, it is understood that the latter is parallel to a generator of the external annular face 48, which is tapered in this case. It is clearly understood that the term generator is used with reference to the general geometric definition of the face but does not indicate that it is continuous over 360° as already explained above.

When the external annular face 48 is concave curved with a concavity turned radially outwards, the full value of the overall definition of the aforementioned plane P will be understood.

Measured in the aforementioned plane p, the angle β1 is that defined between the longitudinal axis X and the tangent to the mean camber line 60 at the leading edge 56 of the fins 50 and is between 45° and 90°, preferably on the order of 80° to 90°, preferably on the order of 85°. This choice of angle makes it possible to adapt the incidence of the fins to the recirculation flow, which has a major tangential component.

Also measured in the aforementioned plane P, the angle β2 is that defined between the longitudinal axis X and the tangent to the mean camber line at the trailing edge 58 of the fins 50 and is on the order of the leading angle between the longitudinal axis X and the tangent to the mean camber line at the leading edge 56 of a blade 18 in the row of stator vanes 14. It can be seen that a specific orientation of the leading edge 56 makes it possible to orient the outgoing air flow of the grid of fins 50 with an ideal incidence in the direction of the grid of stator vanes 14. The angle β2 is between 10° and 75° and preferentially on the order of 55°.

The invention thus reduces the risks of air separation at the root 46 of the blade 18 of the stator vanes 14, thereby increasing the pumping margin of the compressor 10. The reintroduced air also has an orientation that facilitates its flow through the stator vane grid 14.

From a practical point of view, the fins 50 could be executed either by welding on to the annular portion 20*c* upstream from the stator platform 20 or be executed in a single piece with the latter.

In a practical embodiment, the relative pitch defined by S/C will preferably be determined so as not to cause sonic cutoff, between 0.3 and 0.9, wherein S is the circumferential distance between two leading edges 56 of two circumferentially consecutive fins 50 and C is the string of a fin 50.

In an embodiment not specifically shown in the figures, an annular track made of abradable material can be formed on the internal annular face of the downstream annular portion 26*b* of the upstream annular platform 26 of the annular row 10 of rotor vanes. The radially external ends of the fins will therefore be adapted to establish contact with the abradable ring. This configuration will prove interesting in cases in which it is difficult to guarantee absence of contact between the stator fins and the rotor radially opposite.

The invention claimed is:

1. A vane stage extending around a longitudinal axis and designed to be fitted in a turbine engine compressor, the vane stage comprising an annular row of mobile vanes arranged upstream from an annular row of stator vanes, wherein the annular row of stator vanes comprises a radially internal annular platform bearing radial blades, an upstream annular portion of which is arranged upstream from said blades and is surrounded radially outwards by a downstream annular portion of an annular platform of the upstream row of mobile vanes, wherein the upstream annular portion of the annular platform of the annular row of stator vanes comprises a radially external annular face from which fins extend, said fins are distributed around the longitudinal axis and extend radially outwards towards the downstream annular portion of the platform of the annular row of mobile vanes, characterised in that the fins each comprise an intrados face and an extrados face oriented circumferentially in an identical manner to the intrados faces and extrados faces of the blades of the stator vanes.

2. The vane stage of claim 1, wherein an angle between the longitudinal axis and the tangent to the mean camber line at the leading edge of the fins is between 45° and 90°.

3. The vane stage of claim 1, wherein an angle between the longitudinal axis and the tangent to the mean camber line at the trailing edge of the fins is on the order of the leading angle between the longitudinal axis and the tangent to the mean camber line at the leading edge of a blade in the row of stator vanes.

4. The vane stage of claim 3, wherein the angle is between 10° and 75°.

5. The vane stage of claim 1, wherein the external annular face of the upstream annular portion is tapered with a section increasing in the downstream direction.

6. The vane stage of claim 5, wherein said annular face is inclined by an alpha angle relative to the longitudinal axis of between 0° and 90°.

7. The vane stage of claim 1, wherein the relative pitch defined by the ratio S/C is between 0.3 and 0.9, where S is the distance between two leading edges of two circumferentially adjacent fins and C is the string of a fin.

8. A turbine engine compressor comprising at least one stage of claim 1, wherein a downstream annular row of mobile vanes is arranged axially downstream from the annular row of stator vanes and is connected to the annular row of mobile vanes upstream by means of an annular shroud extending radially inside the annular row of stator vanes and bearing lips sealedly interacting with a ring of abradable material borne by a radially internal annular platform of the annular row of stator vanes.

9. A turbine engine comprising the compressor of claim 8.

10. The vane stage of claim 1, wherein the angle between the longitudinal axis and the tangent to the mean camber line at the leading edge of the fins is on the order of 85°.

11. The vane stage of claim 3, wherein the angle is on the order of 55°.

12. The vane stage of claim 5, wherein said annular face is inclined by an alpha angle relative to the longitudinal axis of the order of 30°.

* * * * *